US007874773B2

(12) United States Patent
Awad

(10) Patent No.: US 7,874,773 B2
(45) Date of Patent: Jan. 25, 2011

(54) CHASSIS PACKING SYSTEM

(76) Inventor: Ayman H Awad, 143 Nixon Ave., Staten Island, NY (US) 10304

( * ) Notice: Subject to any disclaimer, the term of this patent is extended or adjusted under 35 U.S.C. 154(b) by 139 days.

(21) Appl. No.: 12/381,618

(22) Filed: Mar. 13, 2009

(65) Prior Publication Data

US 2010/0232926 A1 Sep. 16, 2010

(51) Int. Cl.
*B60P 3/00* (2006.01)

(52) U.S. Cl. ..... 410/32; 410/3; 280/33.991; 414/788.3

(58) Field of Classification Search ..... 410/2, 410/3, 31, 32, 33, 34, 35, 38, 39, 40, 43; 108/53.1, 55.3; 206/499, 507; 414/788.2, 414/788.3, 788.9, 789.5; 280/33.991, 33.995, 280/33.998, 33.997

See application file for complete search history.

(56) References Cited

U.S. PATENT DOCUMENTS

| | | | | |
|---|---|---|---|---|
| 2,915,991 | A * | 12/1959 | Koth et al. | 410/39 |
| 3,789,775 | A * | 2/1974 | Broling et al. | 410/39 |
| 4,650,381 | A * | 3/1987 | Durkin | 410/43 |
| 4,986,705 | A * | 1/1991 | Durkin | 410/57 |
| 7,674,087 | B2 * | 3/2010 | He et al. | 414/802 |
| 2005/0220559 | A1 * | 10/2005 | Yang et al. | 410/56 |
| 2009/0261546 | A1 * | 10/2009 | Rowland | 280/33.997 |
| 2010/0226730 | A1 * | 9/2010 | He et al. | 410/31 |

* cited by examiner

*Primary Examiner*—Patricia L Engle
(74) *Attorney, Agent, or Firm*—John E. Simms, Jr.

(57) ABSTRACT

A semi-trailer chassis packing system capable of packing four stacked semi-trailer chassis in a secure bundle having dimensions of a standard forty foot intermodal shipping container. The chassis packing system includes a first frame assembly, a second frame assembly, and one or more spacers. The first frame assembly includes a pair of elongate first bolster receiving members, a first primary connecting member, and a first secondary connecting member. First bolster receiving members are joined by first detachable pivoting joints to opposite ends of the first primary connecting member. First bolster receiving members pivot to perpendicular orientation with respect to the first primary connecting member, receiving rear bolsters of two stacked trailers into cavities provided in the first bolster receiving members. Second bolster receiving members are joined by second detachable pivoting joints to opposite ends of the second primary connecting member. Second bolster receiving members pivot to perpendicular orientation with respect to the second primary connecting member, receiving rear bolsters of the other two stacked trailers into cavities provided in the second bolster receiving members. First and second secondary connecting members are attached to first and second bolster receiving members, respectively, opposite the first and second primary connecting members, to form a square frame, at each end of the stack of trailers. Each square frame corner is provided with a conventional corner casting such that the packed bundle is suitable for handing as a standard intermodal container.

10 Claims, 10 Drawing Sheets

CHASSIS PACKING SYSTEM

CROSS REFERENCE TO OTHER APPLICATIONS

BACKGROUND

Containerized shipping has significantly reduced the cost of transporting goods, by eliminating the need for separate handling at intermediate points between the initial shipping point and the final destination. The cost savings have been realized by using the process of loading goods into a standardized container and shipping the loaded container to its final destination. When it is necessary to transfer the goods from one mode of transport to another, the container is handled as a unit. Standardized containers are produced with prescribed dimensions, having square ends measuring eight feet on a side and two standard lengths of forty feet and twenty feet. The corners of standard containers are provided with corner castings having flat surfaces to facilitate stacking of the containers and a standard pattern of openings designed to receive equipment for lifting the containers and devices for locking adjacent containers together. A double stacking cone with a twist lock is a conventional device for releasably joining adjacent corner castings of stacked containers. The standard containers are known as intermodal containers, because the standard dimensions and corner castings facilitate handling each container as a unit for loading on appropriately fitted ships, appropriately fitted railroad rolling stock, and on appropriately fitted semi-trailers. The locking devices used for interlocking stacked containers also serve for locking intermodal containers in place on ships, rolling stock, and semi-trailers, which have appropriate fittings, such as corner castings, for interlocking with standard corner castings of the containers.

The semitrailer chassis, which may be pulled by a conventional tractor, is an essential element in the intermodal transportation industry. The semi-trailer chassis consists of one or more longitudinal beams connected with a transverse front bolster and with a transverse rear bolster. The front portion includes a hitch mechanism for attaching the trailer to a tractor and the rear portion includes a wheel set. The trailer includes an intermediate resting stand. The front and rear bolsters are provided with standard corner castings, on outboard ends, such that standard intermodal locks, such as the double stacking cone with twist lock, can be used to secure a standard container on the semi-trailer chassis, to provide a stable load for transportation over a highway.

It is desirable to transport semi-trailer chassis using ship, rail, and truck as means for transportation. A semi-trailer chassis designed to haul standard containers will not fit inside a standard container, so chassis being shipped must be handled as separate items of cargo or must be contained in a specialized packing system. The Maersk Company has designed a specialized packing system for semi-trailers. The Maersk system packs four chassis as a bundle and provides fittings, having standard corner castings, to allow handling of the bundle in intermodal facilities using conventional equipment. An horizontal platform supports the four chassis in a stack. Four upstanding pillars extend from the platform, the ends of the pillars define eight corners, with corner castings, matching the dimensions of a standard intermodal container. The packing system cannot be stacked and cannot be easily broken down. Chassis typically follow a one-way travel route, from a point of manufacture to a point of delivery and it is desirable to have a chassis packing system, which can be easily broken down, for return shipment inside a standard container. There is a need for an improved and stackable intermodal semi-trailer chassis packing system. There is a need for a semi-trailer chassis packing system, which may be easily broken down and re-constructed.

SUMMARY OF THE INVENTION

The chassis packing system of the present invention comprises a first frame assembly, a second frame assembly, and one or more spacers. The packing system stabilizes a stack of semi-trailers, as a secure bundle, which may be handled with conventional intermodal equipment. The first frame assembly includes a pair of elongate first bolster retaining members, a first primary connecting member, and a first secondary connecting member. Each of the first bolster retaining members has a first end and a second end. The first bolster retaining members are aligned in spaced apart relation so as to define an inward facing aspect on each of the first bolster retaining members. The inward facing aspects are provided with one or more cavities. Each of the cavities on one of the first bolster retaining members is located so as to register with one of the cavities on the other of the first bolster retaining members. The first primary connecting member is joined to the first ends of the first bolster retaining members and the first secondary connecting member is joined to the second ends of the first bolster retaining members, forming a square having eight foot sides.

The second frame assembly includes a pair of elongate second bolster retaining members, a second primary connecting member, and a second secondary connecting member. Each of the second bolster retaining members has a first end and a second end. The second bolster retaining members are aligned in spaced apart relation so as to define an inward facing aspect, on each of the second bolster retaining members. The inward facing aspects are provided with one or more cavities. Each of the cavities on one of the second bolster retaining members is located so as to register with one of the cavities on the other of the second bolster retaining members. The second primary connecting member is joined to the first ends of the second bolster retaining members and the second secondary connecting member is joined to the second ends of the second bolster retaining members, forming a square having eight foot sides.

The trailers each have longitudinal beams with a front bolster and a rear bolster mounted at opposite ends. The stack of trailers may be arranged as a stack of four trailers, comprising two pairs of trailers. Each pair of trailers is set front-to-back with undersides adjacent, and a spacer is interposed between an opposed axle of one trailer and the longitudinal beams, of the other trailer. The two pairs of trailers may be stacked with two rear bolsters aligned at each end of the stack. Rear bolsters, on each end of the stack, may be received into the cavities of the first frame assembly, as to one end of the stack and into the cavities of the second frame assembly, as to the other end of the stack. The longitudinal beams of the stacked trailers provide longitudinal rigidity and define a forty foot length of the stack. The first frame assembly and the second frame assembly define square ends, of the stack, having eight foot sides. The corners of each square are provided with standard corner castings, such that the packing system, with a stack of trailers forms a stable unit capable of being handled by conventional intermodal equipment.

It is an object of the present invention to provide a chassis packing system capable of packing a stack of trailers in a stable bundle having dimensions of a standard intermodal shipping container and conventional corner castings.

It is another object of the present invention to provide a chassis packing system which can be easily broken down and re-constructed.

It is yet another object of the present invention to provide a chassis packing system which can be handled by conventional intermodal equipment and can be stacked during storage and transport.

BRIEF DESCRIPTION OF THE DRAWINGS

The features and advantages of the present invention will be better appreciated with reference to the following description, appended claims, and accompanying drawings, where:

DETAILED DESCRIPTION OF THE PREFERRED EMBODIMENT

Figure 1:
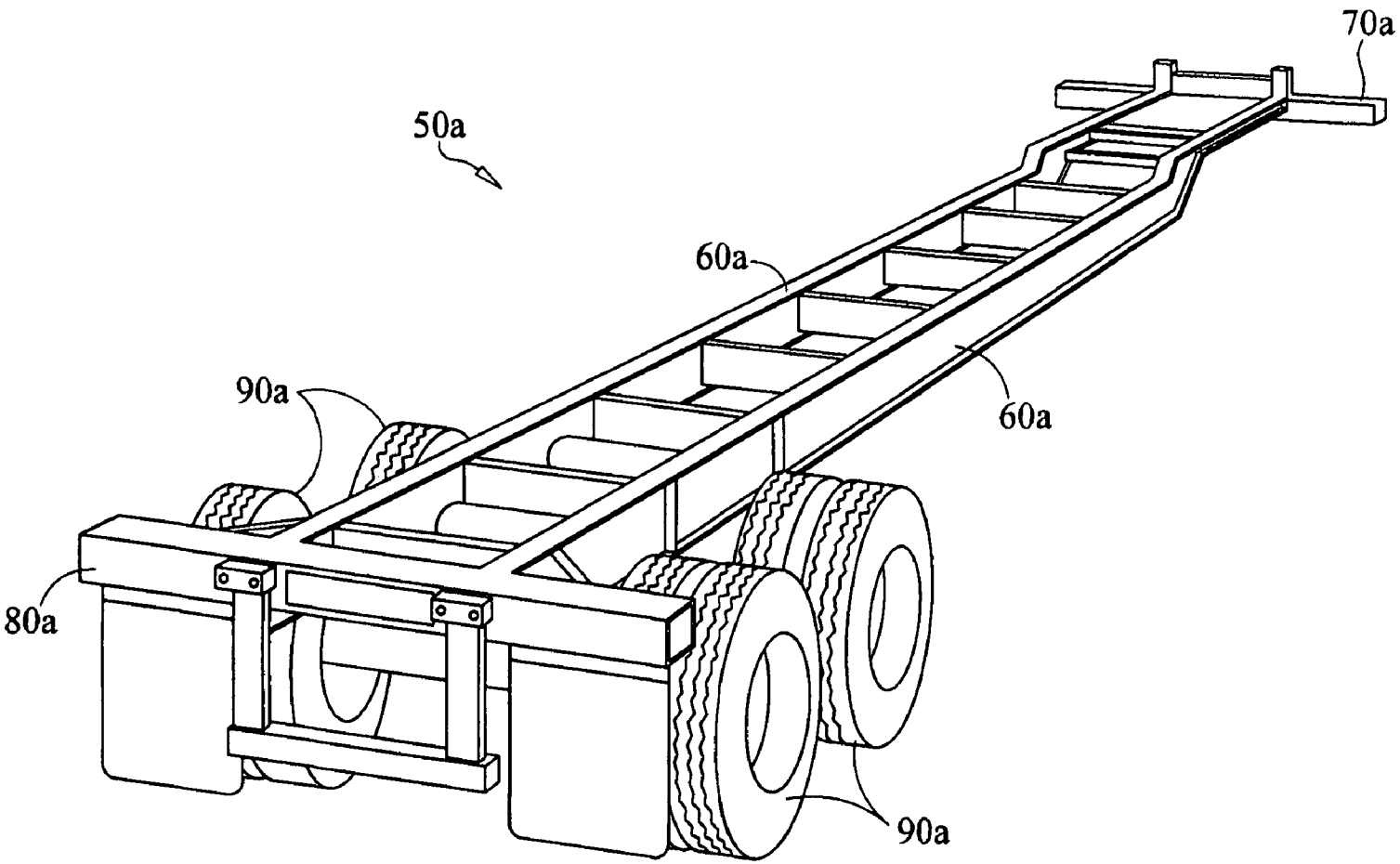
FIG. 1 PRIOR ART
FIG. 1 is a rear perspective view of a semi-trailer chassis, of conventional design

Shown throughout the drawings, the present invention is a compact and portable chassis packing system for semi-trailer chassis, intended for intermodal transportation. A conventional semi-trailer chassis 50*a* is shown in FIG. 1. The chassis 50*a* includes longitudinal I-beams 60*a*, front bolster 70*a*, rear bolster 80*a*, and wheels 90*a*, which are rotatably supported on axles (not shown). The I-beams 60*a* together with the front bolster 70*a* and rear bolster 80*a* form an integral flat bed for receiving a conventional intermodal shipping container.

Figure 2:
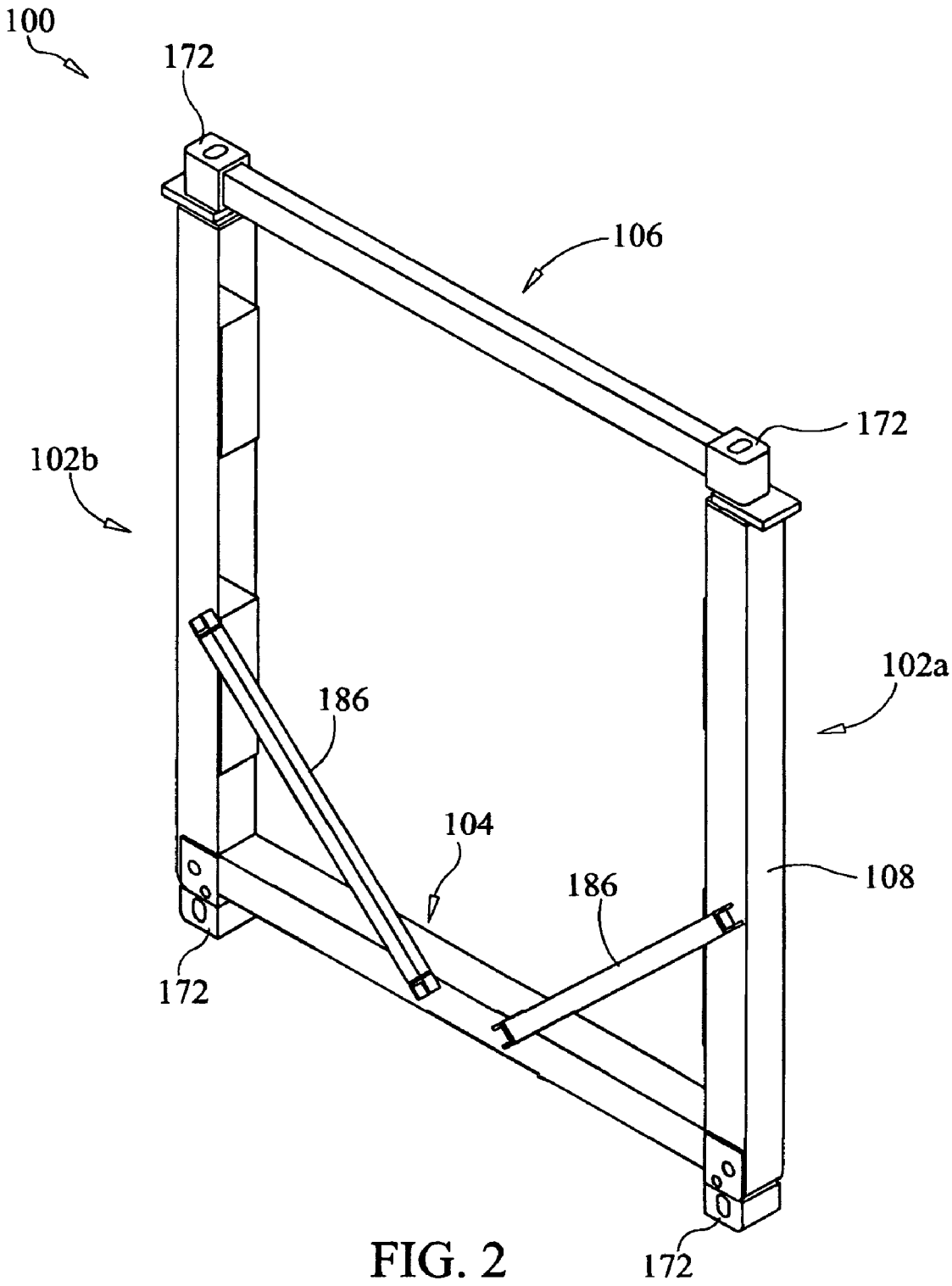
FIG. 2 is a perspective view of a first frame assembly of the present invention
Figure 3:
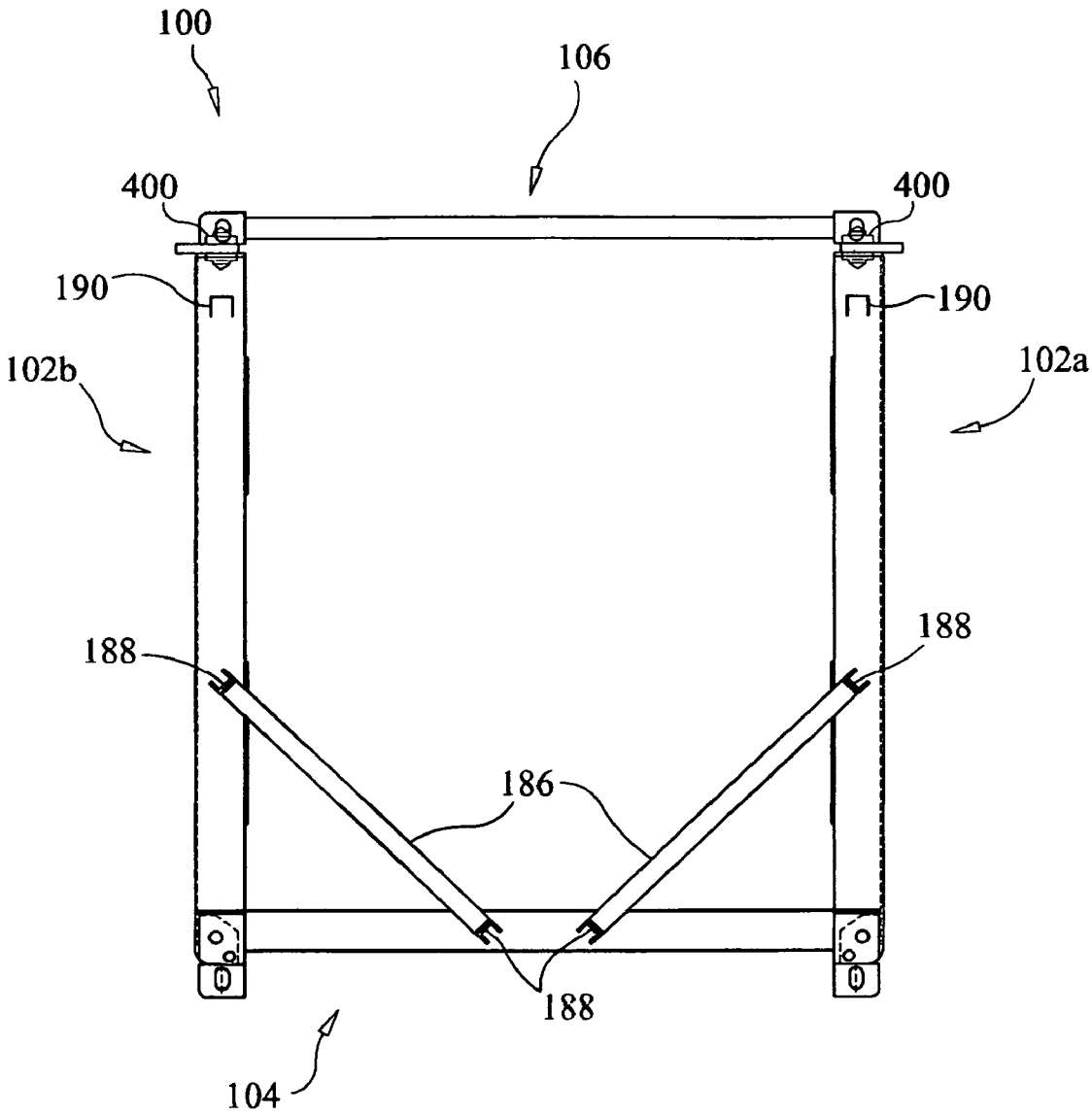
FIG. 3 is an elevation view of a first frame assembly of the present invention
Figure 7:
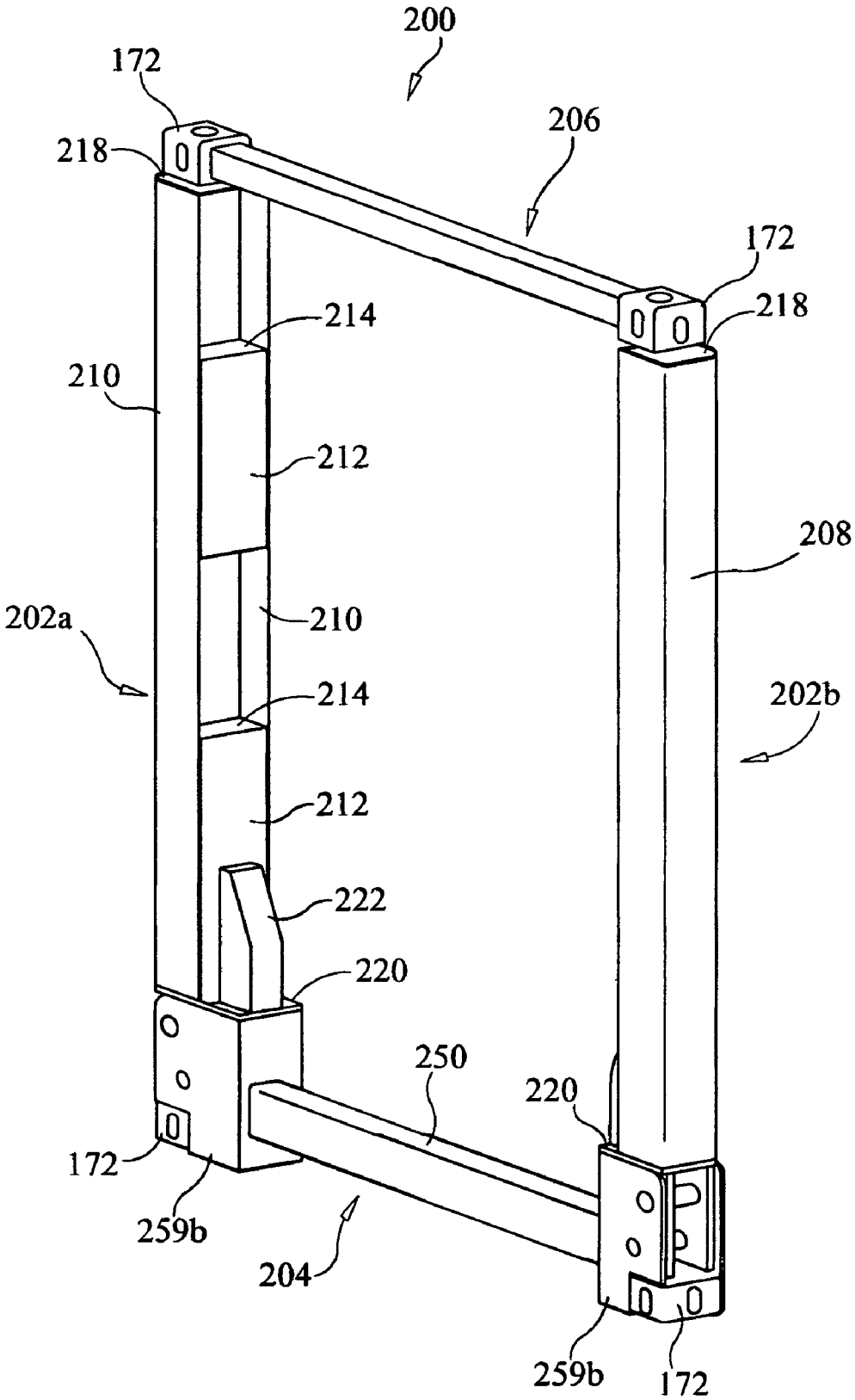
FIG. 7 is a perspective view of a second frame assembly of the present invention
Figure 8:
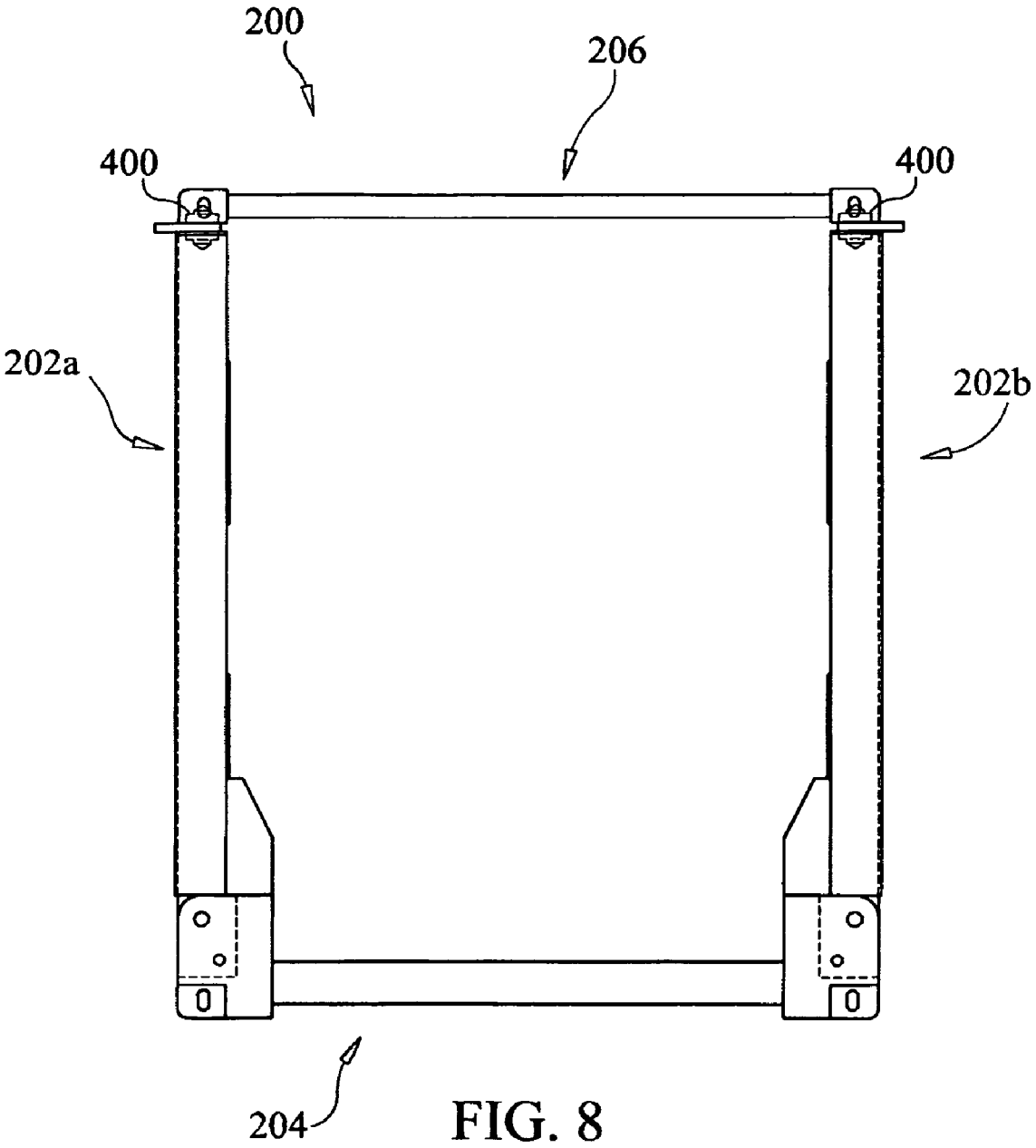
FIG. 8 is an elevation view of a second frame assembly of the present invention
Figure 11:
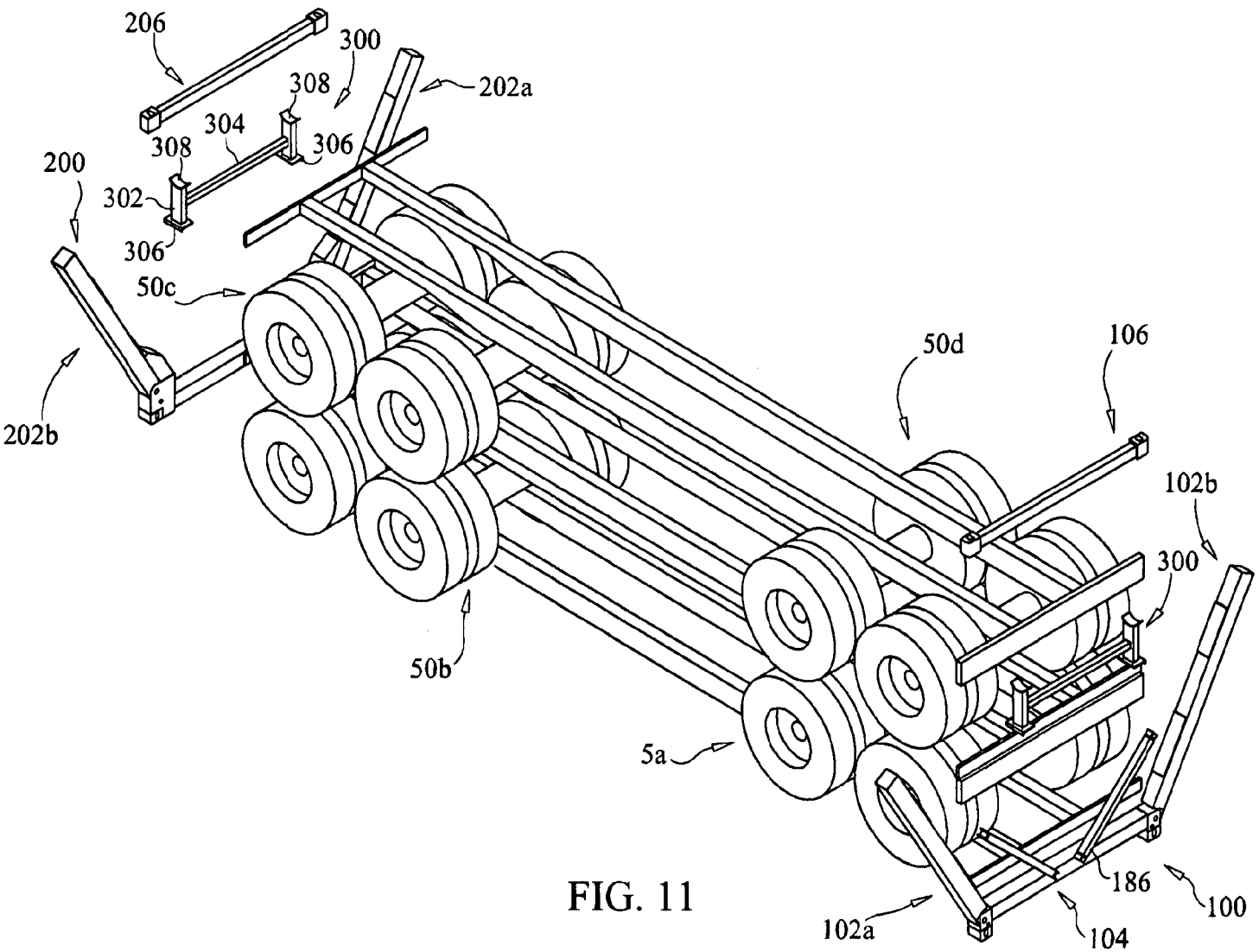
FIG. 11 is an exploded perspective view of a chassis packing system of the present invention with an exploded stack of trailers

The chassis packing system of the present invention includes a first frame assembly 100, shown in FIGS. 2 and 3, a second frame assembly 200, shown in FIGS. 7 and 8, and spacers 300, shown in FIG. 11. The first frame assembly 100 and the second frame assembly 200 each preferably define a square having sides of eight foot length. It is intended that the first frame assembly 100 and the second frame assembly 200 be retained on opposite ends of a stack of semi-trailer chassis defining a forty foot separation and that the spacers 300 be interposed within the stack of chassis to align and stabilize the stack, for forming a unitary bundle having the dimensions of a standard forty foot intermodal shipping container.

Figure 4:
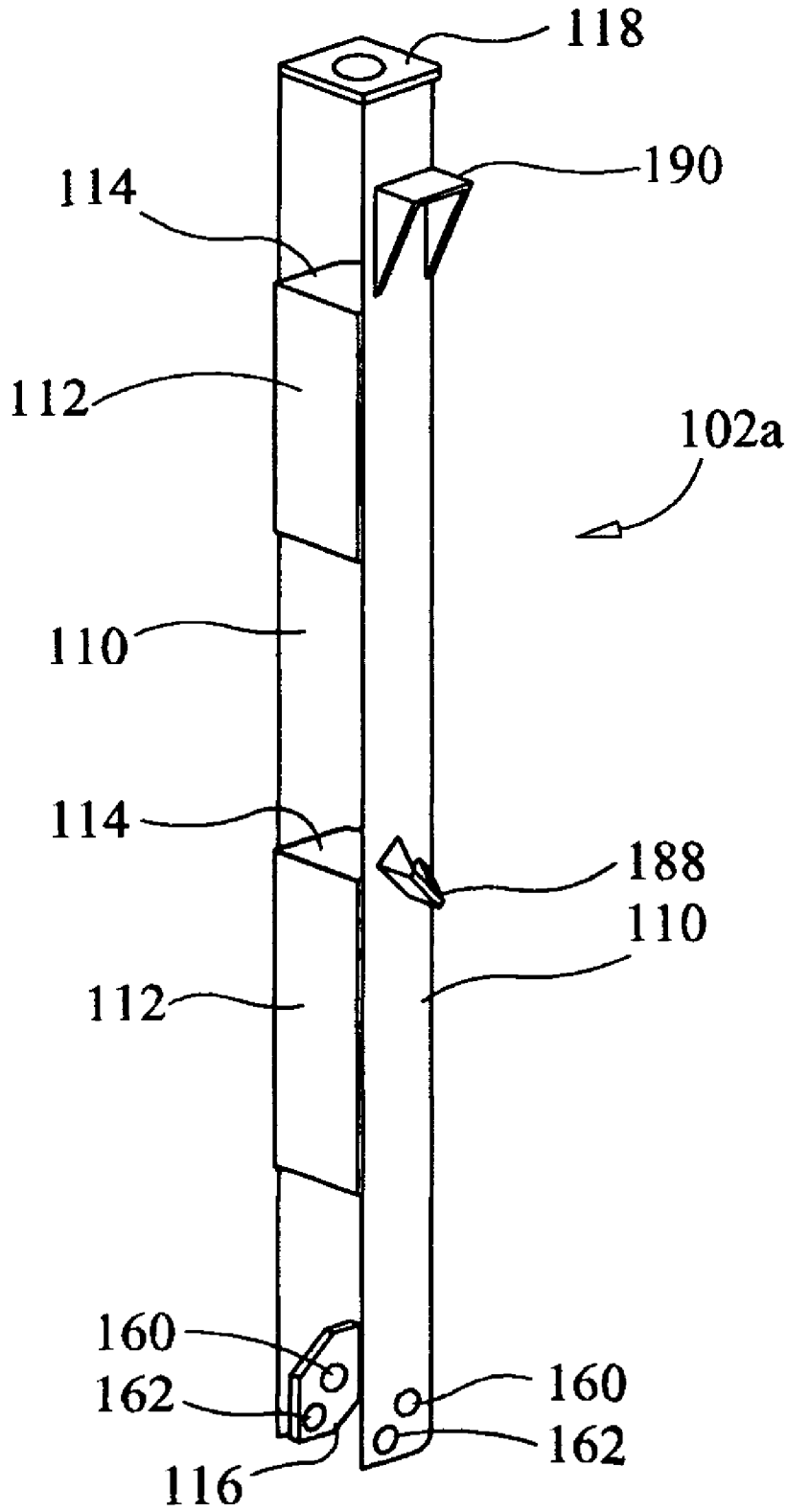
FIG. 4 is a perspective view of a first bolster retaining member, showing the inner aspect

The first frame assembly 100, as shown in FIGS. 2 and 3 includes a pair of first bolster retaining members 102*a* and 102*b*, a first primary connecting member 104, and a first secondary connecting member 106. Each of the first bolster retaining members 102*a* and 102*b* having a first end and a second end. First bolster retaining members 102*a* and 102*b* are aligned in spaced apart relation so as to define an inward facing aspect on each. One first bolster retaining member 102*a* is shown in FIG. 4, by way of example. It is to be understood that first bolster retaining members 102*a* and 102*b* are preferably duplicates of one another and the description is intended to apply to both. The first bolster retaining member 102*a* is preferably formed of an elongate three-sided channel, consisting of a rectangular first back 108, shown in FIG. 2 and, returning to FIG. 4, two spaced apart generally parallel rectangular first walls 110 extending from opposite edges of the first back 108, to define an interior space, the inward facing aspect of the channel being open. One or more first reinforcement plates 112, are attached, preferably by welding, to the first walls 110 so as to span the channel and define cavities accessible on the inward facing aspect and communicating with the interior space of the first bolster retaining member 102*a*. It is preferred that one or more planar first channel stiffeners 114 be included. Each of the first channel stiffeners 114 is disposed transversely in the interior space and may be welded to adjacent portions of, the first back 108, one of the first reinforcement plates 112, and the first walls 110 to stiffen the channel. Stiffener pads 116 are attached, preferably by welding, to each of the first walls 110 in the interior space of the channel and proximate to the first end of the first bolster retaining member 102*a*, as shown in FIG. 4. A first end plate 118 is attached, preferably by welding, to the first back 108 and first walls 110 at the second end of the first bolster retaining member 102*a*.

Figure 5:
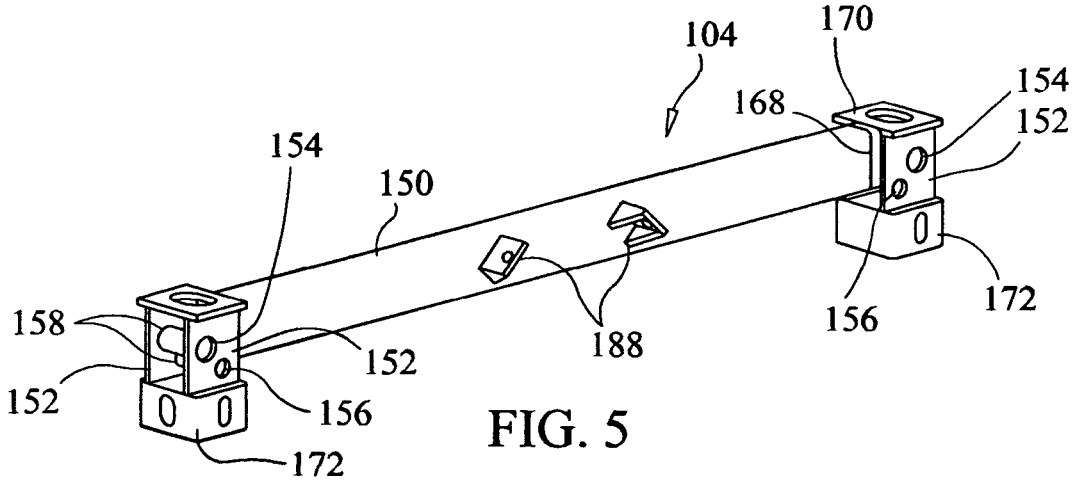
FIG. 5 is a perspective view of a first primary connecting member of the present invention

The first primary connecting member 104, shown in FIG. 5, is preferably formed of a first beam 150 extending between the first bolster retaining members 102*a* and 102*b* and each end of the first beam 150 is joined to the first end of one of the first bolster retaining members 102*a* and 102*b* by first joint means. First joint means preferably comprise a first pivoting detachable joint formed at each end of the first beam 150 of components configured to be received between the stiffener pads 116 proximate to the first end of one of the first bolster retaining members 102*a* and 102*b*. It is preferred that the first pivoting detachable joints should be duplicates of one another and, for purposes of illustration, one such first pivoting detachable joint will be described herein. Each of the first pivoting detachable joints include a pair of spaced apart generally parallel first install plates 152 mounted on an end of the first beam 150. The first install plates 152 and the first bolster retaining members 102*a* and 102*b* include first pivot holes and first lock holes. An aligned pair of first inside pivot holes 154 and a pair of aligned first inside lock holes 156 are provided in the pair of first install plates 152. First guide sleeves 158 extend between the first install plates 152 and register with the first inside pivot holes 154 and with the first inside lock holes 156 respectively. A pair of first outside pivot holes 160 and a pair of first outside lock holes 162 pass through the first walls 110 and stiffener pads 116 of the first bolster retaining members 102*a* and 102*b*, as shown in FIG. 4. The distance between the first install plates 152 is selected to coincide with the distance between the stiffener pads 116 such that the first install plates 152 may be received between the stiffener pads 116 in close fitting slidable engagement. The first inside pivot holes 154 are configured to register with the first outside pivot holes 160 and a first pivot pin (not shown) may be inserted through the first inside pivot holes 154 and first outside pivot holes 160 to join the first primary connecting member 104 to the first end of the first bolster retaining member 102*a* in pivoting relation about an axis defined by the first pivot pin. The first bolster retaining member 102*a* may pivot to a position generally perpendicular to the first primary connecting member 104, bringing the first outside lock holes 162 in position to register with the first inside lock holes 156, in which position a first lock pin (not shown) may be inserted through the first outside lock holes 162 and first inside lock holes 156 to lock the first detachable pivoting joint preventing pivoting movement. The first lock pin may be selectively removed to allow pivoting movement of the first bolster retaining member 102*a* with respect to the first primary connecting member 104. The first pivot pin may also be removed to detach the first bolster retaining member 102*a* from the first primary connecting member 104. It is preferred that the first pivot pin and the first lock pin be provided with conventional retaining means for preventing unintended removal. A cotter pin (not shown) inserted through a transverse hole (not shown) in the first pivot pin and a cotter pin (not shown) inserted through a transverse hole (not shown) in the first lock pin are suitable retaining means. In order to improve the structural integrity of the first detachable pivoting joints, it is preferred that a backing plate 168 be attached between the first install plates 152 and adjacent to the first beam 150. It is also preferred that a first transverse plate 170 be attached to opposed edges of the first install plates 152. It is preferred that the parts of the first frame assembly 100 be formed of metal such as steel and be attached by welding. It is also preferred that conventional shipping container corner castings 172 be attached to the first install plates 152 opposite the first transverse plate 170.

Figure 6:
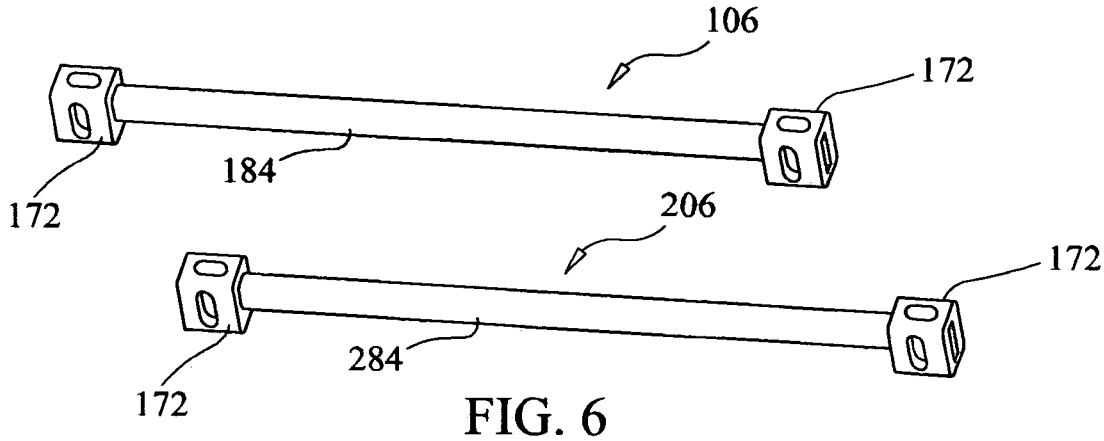
FIG. 6 is a perspective view of a first secondary connecting member and a second secondary connecting member of the present invention

When the first bolster retaining members 102*a* and 102*b* are in position generally perpendicular to the first primary connecting member 104, the first secondary connecting member 106, shown if FIG. 6, may be installed to complete the square shape of the first frame assembly 100, as shown in FIGS. 2 and 3. The first secondary connecting member 106 preferably comprises an elongate first bar 184 having closure means mounted on each end. Closure means are preferably conventional intermodal corner castings 172 attached by welding. It is preferred that the corner castings 172 include a standard set of openings for handling and locking and that the first end plate 118 provided at the second end of each of the first bolster retaining members 102*a* and 102*b* include a complementary opening so that a conventional double stack cone with a twist lock 400, shown in FIG. 3, may be used to releasably lock the corner casting 172 at each end of the first secondary connecting member 106 to the second end of each of the first bolster retaining members 102*a* and 102*b*, respectively.

It is preferred that a pair of struts 186, shown in FIGS. 2 and 3, be attached to the first frame assembly 100 to more securely tie the first bolster retaining members 102*a* and 102*b* to the first primary connecting member 104. A pair of brackets 188 is provided for mounting each of the struts 186. A member of each pair of brackets is affixed to the first primary connecting member 104 at an intermediate location, as shown in FIG. 5. The other member of each pair of brackets 188 is mounted at an intermediate location on each of the first bolster retaining members 102*a* and 102*b*, as shown in FIG. 3. Each of the struts 186 extends between the members of each pair of brackets 188. Struts 186 are preferably formed of steel and releasably attached to the brackets 188 by a nut and bolt (not shown) of conventional design.

Figure 9:
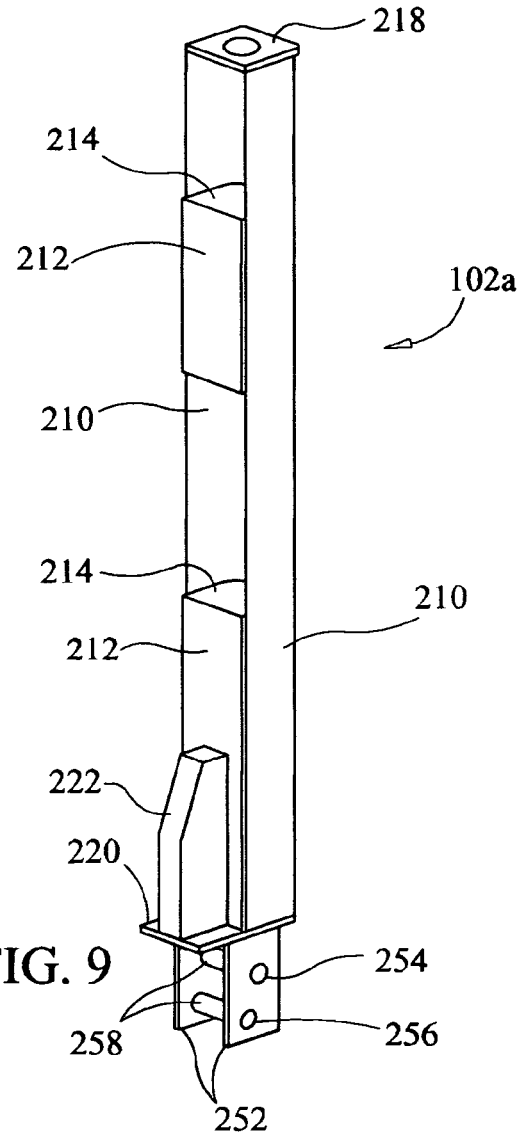
FIG. 9 is a perspective view of a second bolster retaining member, showing the inner aspect

The second frame assembly 200 as shown in FIGS. 7 and 8, includes a pair of second bolster retaining members 202*a* and 202*b*, a second primary connecting member 204, and a second secondary connecting member 206. Each of the second bolster retaining members 202*a* and 202*b* having a first end and a second end. Second bolster retaining members 202*a* and 202*b* are aligned in spaced apart relation so as to define an inward facing aspect on each. One second bolster retaining member 202*a* is shown in FIG. 9, by way of example. It is to be understood that second bolster retaining members 202*a* and 202*b* are preferably duplicates of one another and the description is intended to apply to both. The second bolster retaining member 202*a* is preferably formed of an elongate three-sided channel, consisting of a rectangular second back 208, as shown in FIG. 7, and, returning to FIG. 9, two spaced apart generally parallel rectangular second walls 210 extending from opposite edges of the second back 208, to define an interior space, the inward facing aspect of the channel being open. One or more second reinforcement plates 212, are attached, preferably by welding, to the second walls 210 so as to span the channel and define cavities accessible on the inward facing aspect and communicating with the interior space of the second bolster retaining member 202*a*. It is preferred that one or more planar second channel stiffeners 214 be included. Each of the second channel stiffeners 214 is disposed transversely in the interior space and may be welded to adjacent portions of, the second back 208, one of the second reinforcement plates 212, and the second walls 210 to stiffen the channel. A second end plate 218 is attached, preferably by welding, to the second back 208 and second walls 210 at the second end of the second bolster retaining member 202*a*. A transverse base plate 220 may be affixed to the second back 208 and second walls 210, of the channel, proximate to the first end. It is preferred that the base plate 220 extend laterally, from the second bolster retaining member 202*a*, forming a ledge adjacent to the inward facing aspect and that a support wedge 222 be affixed in the corner formed between the inward facing aspect and the ledge.

Figure 10:
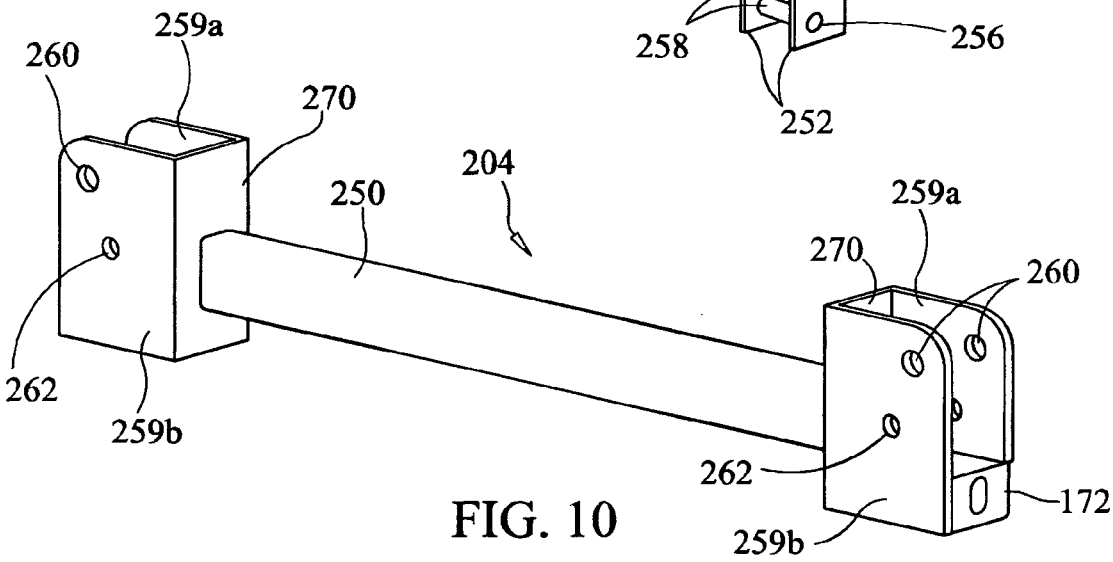
FIG. 10 is a perspective view of a second primary connecting member of the present invention

The second primary connecting member 204, shown in FIG. 10, preferably includes a second beam 250 and extends between the second bolster retaining members 202*a* and 202*b* and each end of the second primary connecting member 204 is joined to the first end of one of the second bolster retaining members 202*a* and 202*b* by second joint means. Second joint means preferably comprise second pivoting detachable joints. It is preferred that the second pivoting detachable joints should be duplicates of one another and, for purposes of illustration, one such pivoting detachable joint, connecting a second bolster retaining member 202*a*, to the second primary connecting member 204, will be described herein. Each of the second pivoting detachable joints includes a pair of spaced apart generally parallel second install plates 252 mounted at the first end of the second bolster retaining member 202*a*, and are affixed to the base plate 220. The second pivoting detachable joints also preferably include a pair of generally parallel spaced apart flanges 259*a* and 259*b* extending longitudinally from the ends of the second beam 250. The second install plates 252 and the flanges 259*a* and 259*b* include second pivot holes and second lock holes. An aligned pair of second inside pivot holes 254 and a pair of aligned second inside lock holes 256 are provided in the pair of second install plates 252. Second guide sleeves 258 extend between the second install plates 252 and register with the second inside pivot holes 254 and with the second inside lock holes 256 respectively. A pair of second outside pivot holes 260 are provided in the flanges 259*a* and 259*b*, in aligned locations. A pair of second outside lock holes 262 are provided in the flanges 259*a* and 259*b* in aligned locations. A second transverse plate 270 is preferably fixed to the end of the beam 250 and between the flanges 259*a* and 259*b* to strengthen the joint. A notch is provided in the flange 259*a* to accommodate a conventional corner casting 172 attached by welding to the periphery of the notch so as to present a face of the corner casting 172 flush with the outside surface of the flange 259*a* and the opposed face of the corner casting 172 may be welded to an adjacent inside surface of the other flange 259*b*.

The distance between the second install plates 252 is selected to coincide with the distance between the flanges 259*a* and 259*b* such that the second install plates 252 may be received between the flanges 259*a* and 259*b* in close fitting slidable engagement. The second inside pivot holes 254 are configured to register with the second outside pivot holes 260 and a second pivot pin (not shown) may be inserted through the second inside pivot holes 254 and second outside pivot holes 260 to join the second primary connecting member 204 to the first end of the second bolster retaining member 202*a* in pivoting relation about an axis defined by the second pivot pin. The second bolster retaining member 202*a* may pivot to a position generally perpendicular to the second primary connecting member 104, bringing the second outside lock holes 262 in position to register with the second inside lock holes 256, in which position a second lock pin (not shown) may be inserted through the second outside lock holes 262 and second inside lock holes 256 to lock the second detachable pivoting joint preventing pivoting movement. The second lock pin may be selectively removed to allow pivoting movement of the second bolster retaining member 202*a* with respect to the second primary connecting member 204. The second pivot pin may also be removed to detach the second bolster retaining member 102*a* from the second primary connecting member 204. It is preferred that the second pivot pin and the second lock pin be provided with conventional retaining means for preventing unintended removal. A cotter pin (not shown) inserted through a transverse hole (not shown) in the second pivot pin and a cotter pin (not shown) inserted through a transverse hole (not shown) in the second lock pin are suitable retaining means. It is preferred that the parts of the second frame assembly 200 be formed of metal such as steel and be attached by welding.

When the second bolster retaining members 202*a* and 202*b* are in position generally perpendicular to the second primary connecting member 204, as shown in FIGS. 7 and 8, the second secondary connecting member 206, shown in FIG. 6, may be installed to complete the square shape of the second frame assembly 200. The second secondary connecting member 206 preferably comprises an elongate second bar 284 having closure means mounted on each end. Closure means are preferably conventional intermodal corner castings 172 attached by welding. It is preferred that the corner castings 172 include a standard set of openings for handling and locking and that the second end plate 218 provided at the second end of each of the second bolster retaining members 202*a* and 202*b* include a complementary opening so that a conventional double stacking cone with a twist lock 400, shown in FIG. 8, may be used to releasably lock the corner casting 172 at each end of the second secondary connecting member 206 to the second end of each of the second bolster retaining members 202*a* and 202*b*, respectively. For convenience of manufacturing, it is preferred that the second secondary connecting member 206 be a duplicate of the first secondary connecting member 106.

Figure 12:
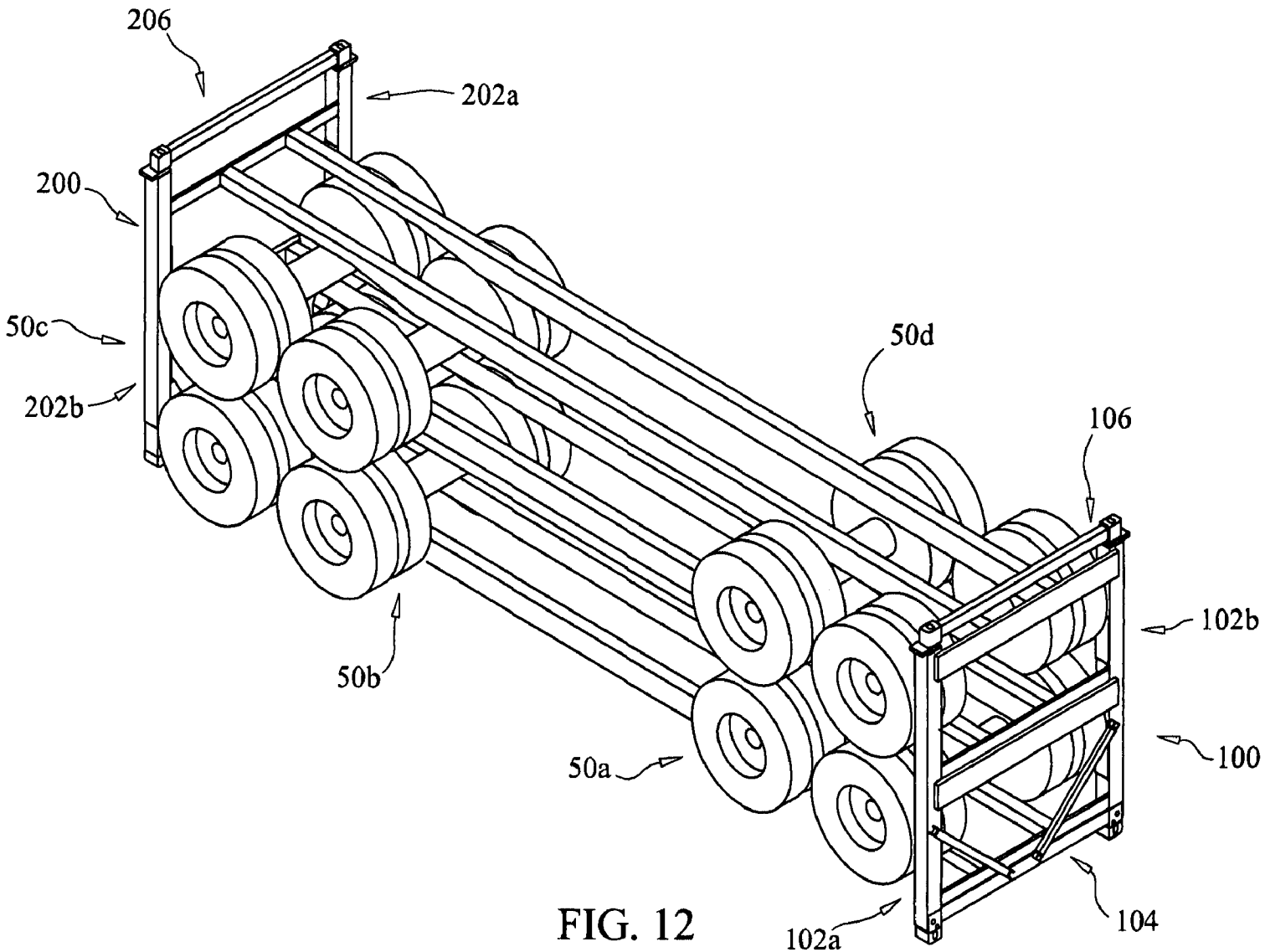
FIG. 12 is a perspective view of a stack of trailers packed in the packing system of the present invention

The first frame assembly 100 and the second frame assembly 200 are intended to define opposite ends of a bundle of stacked semi-trailers, stabilized by spacers 300, shown in FIG. 11. An exemplary stack of trailer chassis 50*a*, 50*b*, 50*c*, and 50*d* is depicted in FIG. 11. The spacers 300 include a pair of spaced apart generally parallel legs 302, each of the legs 302 having a first end and a second end and being rigidly connected by an elongate cross-bar 304. The first end of each of the legs 302 is provided with a foot 306 and the second end of each of the legs 302 is provided with an axle rest 308. The stack of trailer chassis 50*a*, 50*b*, 50*c*, and 50*d* is arranged in pairs, with each pair stacked with undersides adjacent and front-to-back. In FIG. 11, trailer chassis 50*a* and 50*b* are arranged as a pair. One of the spacers 300 is placed with axle supports 308 resting on the axle of trailer chassis 50*a* and feet 306 resting on the I-beams of trailer chassis 50*b*. Trailer chassis 50*c* and 50*d* are arranged as a second pair with one of the spacers 300 placed with axle supports 308 resting on the axle of the trailer 50*c* and feet 306 resting on the I-beams of trailer 50*d*. The pairs are stacked to form the stack of four trailers with front and rear bolsters of adjacent trailers adjacent to each other. It is intended that the first frame assembly 100 and the second frame assembly 200 be arranged at opposite ends of the stack and that the first bolster retaining members 102*a* and 102*b* be pivoted to a perpendicular orientation as to the first primary connecting member 104 and the second bolster retaining members 202*a* and 202*b* be pivoted to a perpendicular orientation as to the second primary connecting member 204, such that the rear bolsters on trailer chassis 50*a* and 50*c*, may be received into the cavities of the first bolster retaining members 102*a* and 102*b*, of the first frame assembly 100, and the rear bolsters of trailer chassis 50*b* and 50*d* may be received into the cavities of the second bolster retaining members 202*a* and 202*b*, of the second frame assembly 200. First secondary connecting member 106 and second secondary connecting member 206 may be connected, by double stacking cones with twist locks, to the second ends of the first bolster retaining members 102*a* and 102*b* and to the second ends of the second bolster retaining members 202*a* and 202*b*, respectively, to define square ends of the bundle, having eight foot sides, shown in FIG. 12. Front bolsters of the trailer chassis 50*a*, and 50*c* rest adjacent to the first frame assembly 100 and may be drawn into firm engagement by ratchet straps (not shown) of conventional design. Struts 186 may be affixed, by bolts and nuts to the brackets 188 of the first frame assembly 100. It is preferred that a pair of bolster rests 190, shown in FIG. 4, be provided and that one of the bolster rests 190 be affixed on each of the first bolster retaining members 102*a* and 102*b*, for receiving the front bolster of trailer chassis 50*d* in supporting relation. Front bolsters of the trailer chassis 50*b* and 50*d* rest adjacent to the second frame assembly and may be drawn into firm engagement by ratchet straps (not shown), of conventional design. Applying tension to the ratchet straps serves to align the first frame assembly 100 and the second frame assembly 200 at a forty foot separation, such that the secure bundle of trailers assumes the dimensions of a standard forty foot intermodal container and the corner castings 172 are appropriately disposed to facilitate handling of the bundle as an conventional intermodal container. The bundle may be lifted by a conventional spreader and moved from ship board, to container rail rolling stock, and to an in-service semi trailer chassis. The bundles may be stacked four high, in a storage yard and may be double stacked on a rail car or placed in a top tier on ship board. The chassis packing system of the present invention may be easily broken down by removing the first and second pivot pins of the first frame assembly 100 and the second frame assembly 200, as well as the first and second lock pins of the first frame assembly 100 and the second frame assembly 200, to dismantle the system, which may then be placed with other chassis packing systems of the present invention in a conventional intermodal container for shipment.

Having fully described the present invention, it may be understood that minor variations may be introduced without departing from the scope of the invention as disclosed and claimed herein.

I claim:

1. A chassis packing system, for packing one or more trailer chassis having longitudinal beams with front bolsters and rear bolsters mounted at opposite ends, said chassis packing system comprising:

a first frame assembly, a second frame assembly, and one or more spacers;

said first frame assembly including a pair of elongate first bolster retaining members, a first primary connecting member, and a first secondary connecting member;

each of said first bolster retaining members having a first end and a second end;

said first bolster retaining members being aligned in spaced apart relation, so as to define an inward facing aspect, on each of said first bolster retaining members;

each of said inward facing aspects having one or more cavities;

each of said cavities on one of said first bolster retaining members being located so as to register with one of said cavities of the other first bolster retaining member;

said first primary connecting member being joined, by first joint means, to said first ends of said first bolster retaining members;

said first secondary connecting member being releasably joined to said second ends of said first bolster retaining members;

said second frame assembly including a pair of elongate second bolster retaining members, a second primary connecting member, and a second secondary connecting member;

each of said second bolster retaining members having a first end and a second end;

said second bolster retaining members being aligned in spaced apart relation so as to define an inward facing aspect, on each of said second bolster retaining members;

each of said inward facing aspects having one or more cavities;

each of said cavities on one of said second bolster retaining members being located so as to register with one of said cavities of the other second bolster retaining member;

said second primary connecting member being releasably joined, by second joint means, to said first ends of said second bolster retaining members;

said second secondary connecting member being joined to said second ends of said second bolster retaining members;

said trailer chassis being arranged in a stack, with one or more of said spacers being placed between adjacent trailers in said stack;

said stack having a first end and a second end;

said first end of said stack being defined by a plurality of rear bolsters aligned in registration with said cavities of said first bolster retaining members and by a plurality of front bolsters aligned adjacent to said first bolster retaining members;

said second end of said stack being defined by a plurality of rear bolsters aligned in registration with said cavities of said second bolster retaining members and by a plurality of front bolsters aligned adjacent to said second bolster retaining members;

said rear bolsters defining said first end of said stack being partially received into said cavities of said first bolster retaining members and said rear bolsters defining said second end of said stack being partially received into said cavities of said second bolster retaining members, for confining said stack of trailer chassis as a unitary bundle in a space defined by said first frame assembly and said second frame assembly;

said first and second frame assemblies having corner castings;

whereby said stack of trailer chassis may be lifted and handled by said corner castings.

2. The chassis packing system of claim 1, wherein:

said first bolster retaining members, and said second bolster retaining members are formed of elongate three-sided channels with an open inward facing aspect; and, reinforcement plates are affixed on said inward facing aspect to define said cavities.

3. The chassis packing system of claim 2, wherein:

said first joint means comprises two pairs of spaced apart generally parallel first install plates, one of said pairs being mounted on each end of the first primary connecting member;

each pair of said first install plates being slidably received into said channel in each of said first bolster retaining members proximate to said first end;

aligned first pivot holes are provided in said first install plates and said channels;

at least two first pivot pins are provided;

said first pivot pins being inserted in said first pivot holes for joining said first bolster retaining members to said first primary connecting members in pivoting relation;

said second joint means including two pairs of spaced apart generally parallel flanges;

one of said pairs being mounted on each end of said second primary connecting member;

said second joint means including two pairs of spaced apart generally parallel second install plates;

one of said pairs being mounted on each first end of said second bolster retaining members;

said second install plates being slidably received between said flanges;

aligned second pivot holes are provided in said flanges and in said second install plates;

at least two second pivot pins are provided;

said second pivot pins being inserted in said second pivot holes for joining said second bolster retaining members to said second primary connecting member in pivoting relation;

whereby said first bolster retaining members may pivot with respect to said first primary connecting member and said second bolster retaining members may pivot with respect to said second primary connecting member causing said rear trailer bolsters to be partially received into said cavities.

4. The chassis packing system of claim 3, further including:

first lock holes provided in said first install plates and said channels of said first bolster retaining members;

at least two first lock pins are provided;

said first lock holes being located so as to register in alignment when said first bolster retaining members are pivoted to perpendicular relation with said first primary connecting member;

said first lock pins being inserted into said first lock holes to prevent pivoting movement of said first bolster retaining members with respect to said first primary connecting member; and including second lock holes provided in said second install plates and in said flanges of said second secondary connecting member;

at least two second lock pins are provided;

said second lock holes being located to register in alignment when said second bolster retaining members are pivoted to perpendicular relation with said second primary connecting member;

said second lock pins being inserted into said second lock holes to prevent pivoting movement of said second bolster retaining members with respect to said second primary connecting member.

5. The chassis packing system of claim 4, wherein said first pivot pins, said second pivot pins, said first locking pins, and said second locking pins are configured so as to be removable for dismantling said first frame assembly and said second frame assembly.

6. A method for packing one or more trailer chassis having longitudinal beams with front bolsters and rear bolsters mounted at opposite ends, said method comprising the steps of:

providing a first frame assembly, a second frame assembly, and one or more spacers;

said first frame assembly including a pair of elongate first bolster retaining members, a first primary connecting member, and a first secondary connecting member;

each of said first bolster retaining members having a first end and a second end;

said first bolster retaining members being aligned in spaced apart relation, so as to define an inward facing aspect, on each of said first bolster retaining members;

each of said inward facing aspects having one or more cavities;

each of said cavities on one of said first bolster retaining members being located so as to register with one of said cavities of the other first bolster retaining member;

joining said first primary connecting member, by first joint means, to said first ends of said first bolster retaining members;

joining said first secondary connecting member releasably to said second ends of said first bolster retaining members;

said second frame assembly including a pair of elongate second bolster retaining members, a second primary connecting member, and a second secondary connecting member;

each of said second bolster retaining members having a first end and a second end;

said second bolster retaining members being aligned in spaced apart relation so as to define an inward facing aspect, on each of said second bolster retaining members;

each of said inward facing aspects having one or more cavities;

each of said cavities on one of said second bolster retaining members being located so as to register with one of said cavities of the other second bolster retaining member;

joining said second primary connecting member, by second joint means, to said first ends of said second bolster retaining members;

joining said second secondary connecting member releasably to said second ends of said second bolster retaining members;

arranging said trailer chassis in a stack, with one or more of said spacers being placed between adjacent trailers in said stack;

said stack having a first end and a second end;

said first end of said stack being defined by a plurality of rear bolsters aligned in registration with said cavities of said first bolster retaining members and by a plurality of front bolsters aligned adjacent to said first bolster retaining members;

said second end of said stack being defined by a plurality of rear bolsters aligned in registration with said cavities of said second bolster retaining members and by a plurality of front bolsters aligned adjacent to said second bolster retaining members;

partially admitting said rear bolsters defining said first end of said stack into said cavities of said first bolster retaining members and partially admitting said rear bolsters defining said second end of said stack into said cavities of said second bolster retaining members, for confining said stack of trailer chassis as a unitary bundle in a space defined by said first frame assembly and said second frame assembly;

providing corner castings on said first and second frame assemblies;

lifting and handling said stack of trailer chassis by said corner castings.

7. The method of claim 6, wherein:

said first bolster retaining members, and said second bolster retaining members are formed of elongate three-sided channels with an open inward facing aspect; and, having reinforcement plates affixed on said inward facing aspect to define said cavities.

8. The method of claim 7, wherein:

said first joint means comprises two pairs of spaced apart generally parallel first install plates, one of said pairs being mounted on each end of the first primary connecting member;

the step of joining the first primary connecting member to the first ends of the first bolster retaining members includes slidably admitting each pair of said first install plates into one of said channels in each of said first bolster retaining members proximate to said first end;

providing aligned first pivot holes in said first install plates and said channels;

providing at least two first pivot pins;

inserting said first pivot pins in said first pivot holes for joining said first bolster retaining members to said first primary connecting members in pivoting relation;

said second joint means including two pairs of spaced apart generally parallel flanges;

one of said pairs being mounted on each end of said second primary connecting member;

said second joint means including two pairs of spaced apart generally parallel second install plates;

one of said pairs being mounted on each first end of said second bolster retaining members;

the step of joining said second primary connecting member to the first ends of said second bolster retaining members includes slidably admitting said second install plates between said flanges;

providing aligned second pivot holes in said flanges and in said second install plates;

providing at least two second pivot pins;

inserting said second pivot pins in said second pivot holes for joining said second bolster retaining members to said second primary connecting member in pivoting relation;

whereby said first bolster retaining members may pivot with respect to said first primary connecting member and said second bolster retaining members may pivot with respect to said second primary connecting member causing said rear trailer bolsters to be partially received into said cavities.

9. The method of claim 8, further including:

providing first lock holes in said first install plates and said channels of said first bolster retaining members;

providing at least two first lock pins;

said first lock holes being located so as to register in alignment when said first bolster retaining members are pivoted to perpendicular relation with said first primary connecting member;

inserting said first lock pins into said first lock holes to prevent pivoting movement of said first bolster retaining members with respect to said first primary connecting member; and including providing second lock holes in said second install plates and in said flanges of said second secondary connecting member;

providing at least two second lock pins;

said second lock holes being located to register in alignment when said second bolster retaining members are pivoted to perpendicular relation with said second primary connecting member;

inserting said second lock pins into said second lock holes to prevent pivoting movement of said second bolster retaining members with respect to said second primary connecting member.

10. The method of claim 9, wherein, said first pivot pins, said second pivot pins, said first locking pins, and said second locking pins are configured so as to be removable for dismantling said first frame assembly and said second frame assembly.

* * * * *